US008610039B2

(12) United States Patent
France et al.

(10) Patent No.: US 8,610,039 B2
(45) Date of Patent: Dec. 17, 2013

(54) VENT ASSEMBLY FOR MICROWAVE COOKING PACKAGE

(75) Inventors: David W. France, Omaha, NE (US); Charles Thomas Gorman, Mahtomedi, MN (US); Clifton Lachmansingh, South Haven, MN (US); Paul John Warosh, Plymouth, MN (US); Steven P. Swanlund, Long Lake, MN (US)

(73) Assignee: ConAgra Foods RDM, Inc., Omaha, NE (US)

( * ) Notice: Subject to any disclaimer, the term of this patent is extended or adjusted under 35 U.S.C. 154(b) by 408 days.

(21) Appl. No.: 12/880,938

(22) Filed: Sep. 13, 2010

(65) Prior Publication Data

US 2012/0061385 A1 Mar. 15, 2012

(51) Int. Cl.
*H05B 6/80* (2006.01)
*B65D 81/34* (2006.01)

(52) U.S. Cl.
USPC ..... 219/727; 219/730; 426/107

(58) Field of Classification Search
USPC ..... 219/727, 730, 734, 735, 759; 426/107, 426/111, 113, 118, 234, 243, 395; 99/DIG. 14; 220/367.1; 229/903, 924, 229/925, 926, 906, 120
See application file for complete search history.

(56) References Cited

U.S. PATENT DOCUMENTS

| | | | |
|---|---|---|---|
| 1,331,590 | A | 2/1920 | Shotwell |
| 1,665,576 | A | 4/1928 | Witham |
| 1,707,853 | A | 4/1929 | Haberman |
| 1,765,862 | A | 6/1930 | Claff |
| 1,944,089 | A | 1/1934 | Litchfield |
| 2,030,295 | A | 2/1936 | Hodge |
| 2,041,227 | A | 5/1936 | Chalmers |
| 2,149,872 | A | 3/1939 | Schmidt |

(Continued)

FOREIGN PATENT DOCUMENTS

| | | |
|---|---|---|
| DE | 1786047 | 11/1972 |
| DK | 81544 | 12/1956 |

(Continued)

OTHER PUBLICATIONS

International Search Report and Written Opinion mailed May 22, 2008 in Application No. PCT/US08/50391.

(Continued)

*Primary Examiner* — Quang Van
(74) *Attorney, Agent, or Firm* — Advent LLP; Ryan T. Grace

(57) ABSTRACT

A vent assembly includes a bag construction configured to contain a food product such as a popcorn charge. The bag construction is formed of at least one sheet of polyester film material and configured to expand from a collapsed configuration to an expanded configuration when the food product is heated in a microwave oven. The vent assembly includes a first portion of the bag construction and a second portion of the bag construction that is configured to be folded against the first portion. The second portion includes a venting structure formed in the sheet of polyester material. An adhesive is applied to at least one of the first portion or the second portion. The adhesive is configured to adhere the first portion to the second portion so that the vent is at least partially sealed while the bag construction is in the collapsed configuration and to release the first portion from the second portion as the bag construction expands to the expanded configuration to allow the vent to at least partially open.

21 Claims, 7 Drawing Sheets

(56) References Cited

U.S. PATENT DOCUMENTS 2,590,580 A 3/1952 Schiavone
2,617,581 A 11/1952 Smith
2,648,479 A 8/1953 Martin
2,673,805 A 3/1954 Colman
2,673,806 A 3/1954 Colman
2,740,576 A 4/1956 Franck
2,741,559 A 4/1956 Banowitz
2,815,164 A 12/1957 Painter
2,815,883 A 12/1957 Robins et al.
2,819,976 A 1/1958 Hines
2,852,898 A 9/1958 Berg
2,858,970 A 11/1958 Barnes et al.
2,865,768 A 12/1958 Barnes et al.
3,024,710 A 3/1962 Gastright
3,027,261 A 3/1962 Samara
3,035,754 A 5/1962 Meister
3,052,554 A 9/1962 Colman
3,054,680 A 9/1962 Mennen
3,107,989 A 10/1963 Fesco
3,140,034 A 7/1964 Wyman et al.
3,144,194 A 8/1964 Cartwright
3,220,635 A 11/1965 Kasting et al.
3,286,832 A 11/1966 Pilger
3,293,048 A 12/1966 Kitterman
3,326,097 A 6/1967 Lokey
3,353,327 A 11/1967 Cutler et al.
3,357,152 A 12/1967 Geigel
3,380,646 A 4/1968 Doyen et al. ..... 383/104
3,425,845 A 2/1969 Dunn
3,519,439 A 7/1970 Dunn
3,556,815 A 1/1971 Fujiwara
3,620,834 A 11/1971 Duffy
3,637,132 A 1/1972 Gray
3,638,784 A 2/1972 Bodolay et al.
3,647,508 A 3/1972 Gorrell
3,671,270 A 6/1972 Jehn
3,721,061 A 3/1973 Bodolay ..... 53/135
3,743,169 A 7/1973 Person ..... 229/31
3,777,447 A 12/1973 Herbine et al.
3,782,976 A 1/1974 Maier et al.
3,835,280 A 9/1974 Gades et al.
3,844,409 A 10/1974 Bodolay et al.
3,851,574 A 12/1974 Katz et al. ..... 426/107
3,873,735 A 3/1975 Chalin et al.
3,873,738 A 3/1975 Zoeller et al. ..... 426/111
3,956,866 A 5/1976 Lattur
3,969,535 A 7/1976 Bourns ..... 426/111
3,970,241 A 7/1976 Hanson
3,973,045 A 8/1976 Brandberg et al. ..... 426/110
4,007,285 A 2/1977 Maier et al. ..... 426/108
4,036,423 A 7/1977 Gordon
4,038,425 A 7/1977 Brandberg et al. ..... 426/107
4,043,098 A 8/1977 Putnam, Jr. et al.
4,051,993 A 10/1977 Castoldi, Jr. ..... 229/22
4,077,853 A 3/1978 Coll-Palagos
4,118,913 A 10/1978 Putnam, Jr. et al.
4,132,811 A 1/1979 Standing et al.
4,136,505 A 1/1979 Putnam, Jr. et al.
4,156,806 A 5/1979 Teich et al.
4,171,605 A 10/1979 Putnam, Jr. et al.
4,184,061 A 1/1980 Suzuki et al.
4,190,757 A 2/1980 Turpin et al.
4,196,331 A 4/1980 Leveckis et al.
4,211,360 A 7/1980 Scott et al. ..... 229/43
4,219,573 A 8/1980 Borek ..... 426/107
4,228,945 A 10/1980 Wysocki
4,230,767 A 10/1980 Isaka et al.
4,230,924 A 10/1980 Brastad et al.
4,241,563 A 12/1980 Müller et al.
4,242,378 A 12/1980 Arai
4,258,086 A 3/1981 Beall
4,260,101 A 4/1981 Webinger ..... 229/41
4,264,668 A 4/1981 Balla
4,267,420 A 5/1981 Brastad
4,279,933 A 7/1981 Austin et al.
4,283,427 A 8/1981 Winters et al.
4,288,027 A 9/1981 Peterson ..... 229/43
4,291,520 A 9/1981 Prince et al.
4,292,332 A 9/1981 McHam ..... 426/111
4,316,070 A 2/1982 Prosise et al.
4,324,088 A 4/1982 Yamashita et al.
4,335,291 A 6/1982 Ishino et al.
4,345,133 A 8/1982 Cherney et al.
4,355,757 A 10/1982 Roccaforte
4,383,637 A 5/1983 Pfieffer et al. ..... 229/38
4,386,706 A 6/1983 Korte ..... 206/628
4,389,438 A 6/1983 Ohtsuki et al.
4,398,994 A 8/1983 Beckett
4,448,309 A 5/1984 Roccaforte et al. ..... 206/525
4,450,180 A 5/1984 Watkins ..... 426/107
4,453,665 A 6/1984 Roccaforte et al. ..... 229/41
4,461,031 A 7/1984 Blamer
4,477,705 A 10/1984 Danley et al. ..... 219/10.55
4,491,220 A 1/1985 Daviss ..... 206/217
4,493,685 A 1/1985 Blamer
4,496,816 A 1/1985 McNamara ..... 219/10.55
4,503,559 A 3/1985 Warnke ..... 383/40
4,509,653 A 4/1985 Corbett ..... 215/231
4,517,045 A 5/1985 Beckett
4,518,651 A 5/1985 Wolfe, Jr.
4,534,505 A 8/1985 Montealegre ..... 229/33
4,548,826 A 10/1985 Watkins ..... 426/394
4,552,614 A 11/1985 Beckett
4,553,010 A 11/1985 Bohrer et al. ..... 219/10.55
4,558,815 A 12/1985 Wischusen, III ..... 229/31
4,571,337 A * 2/1986 Cage et al. ..... 426/107
4,574,956 A 3/1986 Kuchenbecker ..... 206/623
4,584,202 A 4/1986 Roccaforte ..... 426/111
4,586,649 A 5/1986 Webinger
4,596,713 A 6/1986 Burdette ..... 426/107
4,610,755 A 9/1986 Beckett
4,612,431 A 9/1986 Brown et al.
4,640,838 A 2/1987 Isakson et al.
4,641,005 A 2/1987 Seiferth
4,661,671 A 4/1987 Maroszek
4,678,882 A 7/1987 Bohrer et al. ..... 219/10.55
4,685,997 A 8/1987 Beckett
4,691,374 A 9/1987 Watkins et al. ..... 219/10.55
4,701,585 A 10/1987 Stewart
4,705,707 A 11/1987 Winter ..... 428/35
4,705,927 A 11/1987 Levendusky et al.
4,713,510 A 12/1987 Quick et al.
4,724,290 A 2/1988 Campbell ..... 219/10.55
4,727,706 A 3/1988 Beer
4,734,288 A 3/1988 Engstrom et al. ..... 426/107
4,735,513 A 4/1988 Watkins et al.
4,738,287 A 4/1988 Klinkel ..... 141/114
4,738,882 A 4/1988 Rayford et al.
4,794,005 A 12/1988 Swiontek
4,797,010 A 1/1989 Coelho
4,804,582 A 2/1989 Noding et al.
4,806,371 A 2/1989 Mendenhall ..... 426/113
4,806,718 A 2/1989 Seaborne et al.
4,808,421 A 2/1989 Mendenhall et al. ..... 426/107
4,808,431 A 2/1989 Rickert ..... 427/8
4,808,780 A 2/1989 Seaborne
4,810,844 A 3/1989 Anderson ..... 219/10.55
4,810,845 A 3/1989 Seaborne
4,818,831 A 4/1989 Seaborne
4,825,025 A 4/1989 Seiferth
4,851,246 A 7/1989 Maxwell et al. ..... 426/107
4,861,958 A 8/1989 Bohrer et al. ..... 219/10.55
4,864,089 A 9/1989 Tighe et al.
4,864,090 A 9/1989 Maxwell et al. ..... 219/10.55
4,870,238 A 9/1989 Hodgetts et al. ..... 219/10.55
4,873,409 A 10/1989 Spruytenburg et al. .... 219/10.55
4,874,620 A * 10/1989 Mendenhall et al. ..... 426/113
4,878,765 A 11/1989 Watkins et al.
4,883,936 A 11/1989 Maynard et al.
4,892,744 A 1/1990 Ylvisaker ..... 426/111
4,896,009 A 1/1990 Pawlowski
4,904,487 A 2/1990 LaBaw et al. ..... 426/107
4,904,488 A 2/1990 LaBaw et al.
4,914,266 A 4/1990 Parks et al.

(56) References Cited

U.S. PATENT DOCUMENTS

| | | | | |
|---|---|---|---|---|
| 4,915,780 | A | 4/1990 | Beckett | |
| 4,927,648 | A | 5/1990 | Ylvisaker | 426/234 |
| 4,942,050 | A | 7/1990 | Ylvisaker | 426/394 |
| 4,942,277 | A | 7/1990 | Narberes | 219/10.55 |
| 4,943,456 | A | 7/1990 | Pollart et al. | |
| 4,948,932 | A | 8/1990 | Clough | |
| 4,950,859 | A | 8/1990 | Anderson | 219/10.55 |
| 4,952,766 | A | 8/1990 | McDonald | 219/10.55 |
| 4,959,231 | A | 9/1990 | Lakey et al. | 426/111 |
| 4,959,516 | A | 9/1990 | Tighe et al. | |
| 4,963,374 | A | 10/1990 | Brandel et al. | 426/107 |
| 4,972,058 | A | 11/1990 | Benson et al. | 219/10.55 |
| 4,973,810 | A | 11/1990 | Brauner | |
| 4,982,064 | A | 1/1991 | Hartman et al. | |
| 5,003,142 | A | 3/1991 | Fuller | |
| 5,008,024 | A | 4/1991 | Watkins | |
| 5,011,299 | A | 4/1991 | Black, Jr. et al. | 383/126 |
| 5,012,068 | A | 4/1991 | Anderson | 219/730 |
| 5,038,009 | A | 8/1991 | Babbitt | |
| 5,044,777 | A | 9/1991 | Watkins et al. | |
| 5,045,659 | A | 9/1991 | Wolfe et al. | 219/10.55 |
| 5,049,072 | A | 9/1991 | Lueschen | |
| 5,059,036 | A | 10/1991 | Richison et al. | 383/61 |
| 5,061,500 | A | 10/1991 | Mendenhall | 426/118 |
| 5,075,119 | A | 12/1991 | Mendenhall | 426/113 |
| 5,081,330 | A | 1/1992 | Brandberg et al. | |
| 5,095,186 | A | 3/1992 | Scott Russell et al. | |
| 5,097,107 | A | 3/1992 | Watkins et al. | |
| 5,153,402 | A | 10/1992 | Quick et al. | |
| 5,171,594 | A | 12/1992 | Babbitt | 426/107 |
| 5,171,950 | A | 12/1992 | Brauner et al. | 219/10.55 |
| 5,174,658 | A | 12/1992 | Cook et al. | 383/33 |
| 5,190,777 | A | 3/1993 | Anderson et al. | 426/107 |
| 5,195,829 | A | 3/1993 | Watkins et al. | 383/100 |
| 5,200,590 | A | 4/1993 | Bowen et al. | 219/10.55 |
| 5,211,975 | A | 5/1993 | Mendenhall et al. | 426/107 |
| 5,214,257 | A | 5/1993 | Riskey | 219/10.55 |
| 5,223,288 | A | 6/1993 | Mendenhall et al. | 426/107 |
| 5,284,666 | A | 2/1994 | Graf | 426/242 |
| 5,294,764 | A | 3/1994 | Mass | 219/727 |
| 5,294,765 | A | 3/1994 | Archibald et al. | 219/727 |
| 5,298,708 | A | 3/1994 | Babu et al. | |
| 5,302,790 | A | 4/1994 | Turpin | 219/727 |
| 5,306,512 | A | 4/1994 | Blamer | 426/107 |
| 5,344,661 | A | 9/1994 | Mendenhall et al. | 426/107 |
| 5,357,086 | A | 10/1994 | Turpin et al. | 219/732 |
| 5,388,695 | A | 2/1995 | Gilbert | 206/423 |
| 5,405,663 | A | 4/1995 | Archibald et al. | 428/34.3 |
| 5,419,100 | A | 5/1995 | Gwiazdon et al. | 53/482 |
| 5,435,648 | A | 7/1995 | Berkoff | 383/90 |
| 5,461,216 | A | 10/1995 | McDonald | 219/727 |
| 5,463,848 | A | 11/1995 | Gwiazdon et al. | 53/482 |
| 5,468,939 | A | 11/1995 | MacLean, IV | 219/727 |
| 5,473,142 | A | 12/1995 | Mass | 219/727 |
| 5,474,383 | A | 12/1995 | Zuege et al. | 383/121 |
| 5,478,986 | A | 12/1995 | Westerberg | 219/411 |
| 5,480,372 | A | 1/1996 | Gwiazdon et al. | 493/437 |
| 5,488,220 | A | 1/1996 | Freerks et al. | 219/727 |
| 5,496,252 | A | 3/1996 | Gilbert | 493/224 |
| 5,498,080 | A | 3/1996 | Dalea et al. | 383/120 |
| 5,507,132 | A | 4/1996 | Gwiazdon et al. | 53/469 |
| 5,514,854 | A | 5/1996 | Atsaves | 219/727 |
| 5,650,084 | A | 7/1997 | Bley | 219/727 |
| 5,679,278 | A | 10/1997 | Cox | 219/730 |
| 5,690,853 | A | 11/1997 | Jackson et al. | 219/727 |
| 5,690,979 | A | 11/1997 | Bourns et al. | 426/307 |
| 5,695,673 | A | 12/1997 | Geissler | 219/727 |
| 5,753,895 | A | 5/1998 | Olson et al. | |
| 5,770,839 | A | 6/1998 | Ruebush et al. | 219/727 |
| 5,772,331 | A | 6/1998 | Irace et al. | 383/90 |
| 5,773,801 | A | 6/1998 | Blamer et al. | 219/727 |
| 5,775,570 | A | 7/1998 | Kim | 229/4.5 |
| 5,780,824 | A | 7/1998 | Matos | 219/727 |
| 5,814,382 | A | 9/1998 | Yannuzzi, Jr. | 428/34.3 |
| 5,834,046 | A | 11/1998 | Turpin et al. | |
| D401,846 | S | 12/1998 | Nguyen | D9/305 |
| 5,871,790 | A | 2/1999 | Monier et al. | 426/107 |
| 5,928,550 | A | 7/1999 | Weiss | 219/620 |
| 5,928,554 | A | 7/1999 | Olson et al. | |
| 5,958,482 | A | 9/1999 | Monforton | 426/107 |
| 5,985,343 | A | 11/1999 | Hasse, Jr. et al. | 426/394 |
| 5,993,869 | A | 11/1999 | Freeport | 426/107 |
| 5,994,685 | A | 11/1999 | Jackson et al. | 219/727 |
| 6,001,209 | A | 12/1999 | Popat et al. | 156/249 |
| 6,005,234 | A | 12/1999 | Moseley et al. | 219/727 |
| 6,030,652 | A | 2/2000 | Hanus | 426/107 |
| 6,046,443 | A | 4/2000 | Ackerman et al. | 219/727 |
| 6,049,072 | A | 4/2000 | Olson et al. | 219/727 |
| 6,060,095 | A | 5/2000 | Scrimager | 426/107 |
| 6,060,096 | A | 5/2000 | Hanson et al. | |
| 6,066,346 | A | 5/2000 | Hunt et al. | |
| 6,077,551 | A | 6/2000 | Scrimager | 426/107 |
| 6,100,513 | A | 8/2000 | Jackson et al. | 219/727 |
| 6,126,976 | A | 10/2000 | Hasse, Jr. et al. | 426/107 |
| 6,137,095 | A | 10/2000 | Kashimoto et al. | 219/727 |
| 6,149,955 | A | 11/2000 | Wilson | 426/112 |
| 6,231,903 | B1 | 5/2001 | Ji et al. | 426/107 |
| 6,254,907 | B1 | 7/2001 | Galomb | 426/115 |
| 6,259,079 | B1 | 7/2001 | Ji et al. | 219/727 |
| 6,320,172 | B1 | 11/2001 | Watkins | 219/725 |
| D453,679 | S | 2/2002 | Blackburn | D9/305 |
| 6,350,974 | B1 | 2/2002 | Manzano et al. | 219/735 |
| 6,394,265 | B1 | 5/2002 | Tsao | 206/217 |
| 6,396,036 | B1 | 5/2002 | Hanson | |
| 6,410,065 | B1 | 6/2002 | Nottingham et al. | |
| 6,431,415 | B1 | 8/2002 | Schreiber | 222/460 |
| 6,586,715 | B2 | 7/2003 | Watkins | 219/725 |
| 6,644,540 | B2 | 11/2003 | Jamitzky et al. | 229/120.11 |
| 6,651,947 | B1 | 11/2003 | Price | 248/311.2 |
| 6,660,983 | B2 | 12/2003 | Monforton et al. | 219/727 |
| D486,388 | S | 2/2004 | Rauen | D9/305 |
| 6,733,807 | B2 | 5/2004 | Martuch et al. | 426/107 |
| 6,752,071 | B1 | 6/2004 | Snyder | 99/323.5 |
| 6,872,923 | B2 | 3/2005 | Cretors et al. | 219/494 |
| 6,875,969 | B2 | 4/2005 | Lee | 219/707 |
| 6,884,978 | B2 | 4/2005 | Monforton et al. | 219/727 |
| 6,906,299 | B2 | 6/2005 | Watkins | 219/725 |
| 6,960,748 | B2 | 11/2005 | Baker | 219/725 |
| 7,022,359 | B2 | 4/2006 | Gibernau | 426/107 |
| 7,067,781 | B2 | 6/2006 | Trochlil | 219/730 |
| 7,086,545 | B2 | 8/2006 | Mannion et al. | 211/181.1 |
| D598,784 | S | 8/2009 | Anderson et al. | D9/708 |
| D617,654 | S | 6/2010 | Tawinsook | D9/702 |
| D639,181 | S | 6/2011 | Woodfield | D9/705 |
| D671,012 | S | 11/2012 | France et al. | D9/702 |
| 2001/0033883 | A1 | 10/2001 | Boody | 426/120 |
| 2002/0043532 | A1 | 4/2002 | Watkins | 219/725 |
| 2002/0088730 | A1 | 7/2002 | Galomb | 206/459.5 |
| 2002/0100755 | A1 | 8/2002 | Peterson | 219/727 |
| 2002/0106427 | A1 | 8/2002 | Martuch et al. | 426/107 |
| 2002/0125306 | A1 | 9/2002 | Jamitzky et al. | 229/120.11 |
| 2002/0127306 | A1 | 9/2002 | Schmidt et al. | 426/107 |
| 2002/0145295 | A1 | 10/2002 | Frank et al. | 294/31.2 |
| 2002/0182291 | A1 | 12/2002 | Renini et al. | 426/107 |
| 2003/0012853 | A1 | 1/2003 | Jensen et al. | 426/107 |
| 2003/0044492 | A1 | 3/2003 | Knigge et al. | 426/124 |
| 2003/0049354 | A1 | 3/2003 | Murray | |
| 2003/0080118 | A1 | 5/2003 | Hanson | 219/730 |
| 2003/0106899 | A1 | 6/2003 | Langen | 220/912 |
| 2003/0194472 | A1 | 10/2003 | Jensen et al. | 426/107 |
| 2004/0013773 | A1 | 1/2004 | Duran Vila et al. | 426/107 |
| 2004/0031790 | A1 | 2/2004 | Kim | 219/727 |
| 2004/0089656 | A1 | 5/2004 | Watkins | 219/759 |
| 2004/0096550 | A1 | 5/2004 | Schilmoeller et al. | |
| 2004/0104222 | A1 | 6/2004 | Lee | 219/707 |
| 2004/0105917 | A1 | 6/2004 | Mannion et al. | 426/110 |
| 2004/0219332 | A1 | 11/2004 | Dean et al. | 428/131 |
| 2004/0238535 | A1 | 12/2004 | Mast | 219/730 |
| 2004/0238538 | A1 | 12/2004 | Cosentino | 220/23.83 |
| 2004/0245240 | A1 | 12/2004 | Cretors et al. | 219/494 |
| 2005/0040174 | A1 | 2/2005 | Costello et al. | 220/670 |
| 2005/0045624 | A1 | 3/2005 | Groll | 219/621 |
| 2005/0067411 | A1 | 3/2005 | Monforton et al. | 219/727 |
| 2005/0077291 | A1 | 4/2005 | Baker | 219/725 |

(56) References Cited

U.S. PATENT DOCUMENTS

| | | | | |
|---|---|---|---|---|
| 2005/0092623 | A1 | 5/2005 | Cuomo | 206/162 |
| 2005/0121444 | A1 | 6/2005 | Trochlil | 219/730 |
| 2005/0199620 | A1 | 9/2005 | Fish | 219/730 |
| 2005/0230459 | A1 | 10/2005 | Johnson et al. | 229/80 |
| 2005/0276885 | A1 | 12/2005 | Bennett | |
| 2006/0018999 | A1 | 1/2006 | Risch | 426/107 |
| 2006/0062956 | A1 | 3/2006 | Chandaria et al. | 428/43 |
| 2006/0078655 | A1 | 4/2006 | Plank et al. | 426/107 |
| 2006/0127549 | A1 | 6/2006 | Murray | |
| 2006/0131303 | A1 | 6/2006 | Trochlil | 219/730 |
| 2006/0191985 | A1 | 8/2006 | Norcom | |
| 2006/0204622 | A1 | 9/2006 | Renini et al. | 426/107 |
| 2006/0231552 | A1 | 10/2006 | Caya | 219/727 |
| 2006/0261060 | A1 | 11/2006 | Baez | 220/4.21 |
| 2006/0289513 | A1 | 12/2006 | Raughley | 219/729 |
| 2006/0289524 | A1 | 12/2006 | Ludwig et al. | 219/734 |
| 2007/0284369 | A1 | 12/2007 | Murray | |
| 2008/0166457 | A1 | 7/2008 | Gorman et al. | 426/107 |
| 2008/0178744 | A1 | 7/2008 | Hill | 99/323.5 |
| 2011/0070391 | A1 | 3/2011 | Cotton | 428/43 |

FOREIGN PATENT DOCUMENTS

| | | | | |
|---|---|---|---|---|
| EP | 0 823 388 | A1 | 2/1998 | B65D 81/34 |
| JP | 2005-516853 | A | 6/2005 | A47J 27/00 |
| RU | 2304075 | | 4/2005 | |
| WO | 2004048225 | | 6/2004 | |

OTHER PUBLICATIONS

Accessed at http://www.emeraldnuts.com/ Easy Open Pull String, on Dec. 4, 2009; 1 pg.

European Search Report and Written Opinion mailed Apr. 29, 2010 in Application No. 08713616.4.

U.S. Official Action mailed Feb. 23, 2012, in U.S. Appl. No. 11/970,349.

U.S. Official Action mailed Apr. 23, 2012, in U.S. Appl. No. 12/559,094.

U.S. Official Action mailed Apr. 23, 2012, in U.S. Appl. No. 29/394,183.

U.S. Official Action mailed Jun. 1, 2012, in U.S. Appl. No. 29/394,187.

U.S. Official Action mailed Jun. 15, 2012, in U.S. Appl. No. 11/970,349.

U.S. Official Action mailed Jun. 26, 2012, in U.S. Appl. No. 12/953,123.

International Search Report and Written Opinion mailed Jun. 30, 2011, in Application No. PCT/US2010/048762.

U.S. Official Action mailed Jul. 18, 2012, in U.S. Appl. No. 29/394,193.

U.S. Official Action mailed Nov. 6, 2012, in U.S. Appl. No. 12/953,123.

U.S. Official Action mailed Dec. 6, 2011, in U.S. Appl. No. 12/559,094.

U.S. Official Action mailed Feb. 4, 2013, in U.S. Appl. No. 29/394,183.

* cited by examiner

VENT ASSEMBLY FOR MICROWAVE COOKING PACKAGE

BACKGROUND

Microwave cooking packages, and, in particular, microwave popcorn packages in current commercial use, typically employ two-ply paper constructions in which inner and outer flexible paper sheets or plies are laminated to one another, typically with a microwave interactive sheet, typically referred to as a microwave susceptor, encapsulated between the two flexible paper sheets. The resulting microwave popcorn packages can be provided in a bag form that may be collapsed and folded when stored before use (e.g., when packaged for shipping, sale, and storage by a consumer). During popping, when a popcorn charge within the packages is exposed to microwave energy in a microwave oven, the bags unfold and expand. When the popping operation is completed, the bag is opened and the contents emptied into a container such as a bowl or basket for consumption. The microwave popcorn package may then be collapsed for disposal. When a container is not available, the consumer may instead reach into the bag to obtain the contents.

SUMMARY

A vent assembly for a microwave cooking package is disclosed. The microwave cooking package includes a bag construction configured to contain a food product. The bag construction is formed of at least one sheet of polyester film material and configured to expand from a collapsed configuration to an expanded configuration when the food product is heated in a microwave oven. The vent assembly includes a first portion of bag construction and a second portion of a bag construction that is configured to be folded against the first portion. The second portion includes a venting structure formed in the sheet of polyester material. An adhesive is applied to at least one of the first portion or the second portion. The adhesive is configured to adhere the first portion to the second portion so that the vent is at least partially sealed while the bag construction is in the collapsed configuration and to release the first portion from the second portion as the bag construction expands to the expanded configuration to allow the vent to at least partially open. In one or more implementations, the microwave cooking package may comprise a microwave popcorn package. In such implementations, the bag construction may be secured to an interior of a sidewall construction and may contain a popcorn charge as the food product.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The detailed description is described with reference to the accompanying figures. In the figures, the use of the same reference numbers in different instances in the description and the figures may indicate similar or identical items.

DETAILED DESCRIPTION

Overview

Figure 1:
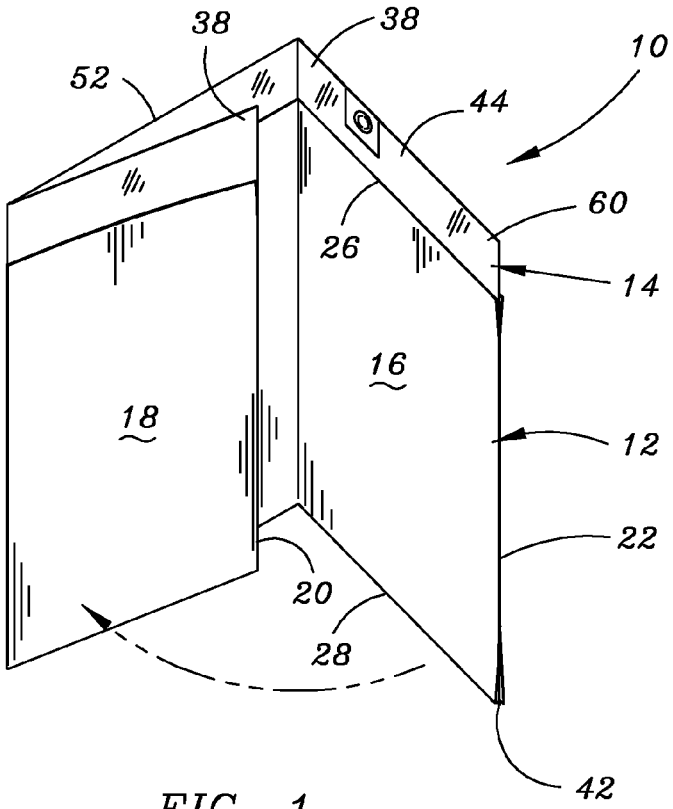
FIG. 1 is an isometric view illustrating an example microwave cooking package, in particular, a microwave popcorn package, having a vent assembly in accordance with the present disclosure.

Microwave cooking packages may be used to facilitate cooking of a variety of food products in a microwave oven. In particular, in some implementations, microwave cooking packages may be configured as microwave popcorn packages used to pop popcorn. In such implementations, the microwave cooking package (microwave popcorn package) may employ a bag construction formed of polyester film material such as a biaxially-oriented polyethylene terephthalate (PET) film.

The bag construction may be secured to an interior of a sidewall construction and may contain a popcorn charge as the food product. To form the bag construction, one or more sheets of polyester (e.g., PET) film are folded to create expansion structures such as gussets, or the like, that allow the bag construction to expand to hold the popped popcorn. Edges of the polyester sheet are then sealed to one another using an adhesive (e.g., a water-based adhesive), forming seals, to hold the popcorn within the bag construction for shipping, storage, and popping. Following a popping operation (e.g., following popping of the one or more popcorn kernel(s) in the popcorn charge by heating the microwave popcorn package in a microwave oven), the bag construction and the sidewall construction may form a container having vertically rigid sidewalls to facilitate consumption of the popped popcorn.

During popping, the bag construction is expanded from a collapsed configuration to an expanded configuration by steam generated during popping and/or the expanded volume of the popped popcorn. This expansion of the bag construction due to increased pressure therein places stress on the seals of the bag construction, which, in some instances, could cause the seals to open spilling the contents (e.g., unpopped popcorn kernels, oils, seasonings, popped popcorn, and so on) from the package.

Accordingly, a vent assembly is disclosed for a microwave cooking package that comprises a bag construction formed of polyester film material such as a PET film, or the like. The vent assembly is formed within the bag construction and includes a first portion of the bag construction and a second portion of the bag construction that is configured to be folded against the first portion. For example, in one implementation, the vent assembly may be formed near a fold of a gusset of the bag construction so that the first portion and the second portion are positioned on either side of the fold. The second portion includes a venting structure formed in the sheet of polyester (e.g., PET) film material from which the bag construction is fabricated.

An adhesive is applied to at least one of the first portion or the second portion of the bag construction. While the bag construction is in the collapsed configuration (i.e. prior to popping), the adhesive adheres the first portion to the second portion so that the vent is at least partially sealed. However, as the bag construction expands to the expanded configuration during popping, the adhesive is configured to release the first portion from the second portion to allow the vent to at least partially open venting the bag construction. As utilized herein, the term "at least partially sealed" may be employed to describe a condition wherein the first portion and the second portion of the vent assembly seal the vent sufficiently to prevent substantial spilling the contents (e.g., unpopped popcorn kernels, oils, seasonings, popped popcorn, and so on) from the package. Similarly, the term "at least partially open" may be employed to describe a condition wherein the vent is sufficiently open to vent pressure and/or steam within the bag construction.

In an implementation, the vent is comprised of one or more generally curved scores formed in the second portion that at least partially open when the first portion is released from the second portion. For example, the vent may comprise a first semi-circular score and a second semi-circular score, in mirrored relation to the first semi-circular score. The mirrored first and second semi-circular scores may be spaced apart from one another to form a land area there between.

Example Microwave Cooking Package

An example microwave cooking package that employs a bag construction formed of polyester film material such as a PET film, which may be provided with a vent assembly in accordance with the present disclosure, is now described. In the figures discussed herein below, some relative material thicknesses and component sizes may be shown exaggerated, to facilitate an understanding of the disclosure. Additionally, as used herein, the terms "top" and "bottom" are used to refer to components, with reference to relative location after the package is configured in an expanded configuration and is stood up, for normal use. Thus, the terms "top" and "bottom" may be used to identify components even when those components are in the collapsed configuration, but with reference to eventual relative locations once the package is expanded and positioned stood on its bottom or base, for normal use.

FIGS. 1 through 4 illustrate an example microwave cooking package that is configured as a microwave popcorn package 10 suitable for use in popping popcorn in a microwave oven. As shown, the microwave popcorn package 10 includes a sidewall construction 12 and a flexible bag construction 14. The example sidewall construction 12 depicted includes first and second panels 16, 18 extending between ends 20, 22. The first and second panels 16, 18 may comprise separate pieces of material secured to one another, or, the panels 16, 18 may be folded from a single piece of material. For the particular sidewall construction 12 shown, each of the first and second panels 16 and 18 may be fabricated of a material that is adapted to be curved or configured from a flat or collapsed configuration into an expanded configuration having a generally convex arrangement, such as, for example a curved (e.g., ring) arrangement, a faceted (e.g., polygonal) arrangement, an irregular curved arrangement, and so on, to define the open top 24 depicted in FIG. 3. In the example shown, the first and second panels 16, 18 are generally identical to one another, positioned as mirror images in the microwave popcorn package 10.

In general, the sidewall construction 12 may be vertically rigid. By the term "vertically rigid" and variants thereof, in this context, it is meant that the sidewall construction 12 is resistant to collapse when stood up in the orientation shown in FIG. 3, in the vertical direction. However, the term "vertically rigid" is not necessarily meant to suggest the microwave popcorn package 10 cannot be collapsed, but rather that the package 10 is resistant to collapse under ordinary use conditions, and is more resistant to collapse than would be a flexible paper bag construction alone.

In implementations, the first and second panels 16, 18 may be fabricated of a paper or paperboard material. Herein, the term "paperboard" is meant to include various materials, including various forms of fiber board and cardboard provided the material selected is sufficiently vertically rigid to resist vertical collapse under conditions of normal use, when positioned as shown. A variety of paper and paperboard materials may be used provided the materials have sufficient vertical rigidity to function as an end container. For example, in an implementation, the first and second panels 16, 18 may be fabricated from a paper material of sufficient weight (e.g., gauge) to allow the panels 16, 18 to have substantial vertical rigidity in the direction from top edge 26 to bottom edge 28. In one example, the material used in fabrication of first and second panels 16, 18 may comprise a paper material having a weight of at least 60 lbs. per ream. However, paper materials having weights lighter than 60 lbs. per ream may also be used to fabricate the first and second panels 16, 18. Additionally, other materials such film materials, plastic materials, and the like, may be used.

As shown, the sidewall construction 12 defines an interior 30 in which the flexible bag construction 14 is received. A food product, in this case, a microwave poppable popcorn charge 32, is contained within an interior 34 of the flexible bag construction 14. The first and second panels 16, 18, are joined at side ends 20, 22 with portions of the flexible bag construction 14 (in particular, portions of side seams formed in the bag construction 14) captured there between. The amount of curvature obtained in the first and second panels 16, 18 may depend upon such factors as: the thickness of the first and second panels 16, 18; the length of the first and second panels 16, 18 between the side ends 20, 22; the extent to which the package 10 is manipulated into the generally convex construction by the consumer; and so on.

As noted, the flexible bag construction 14 is comprised of a film material such as a polyester film material (e.g., a biaxially-oriented polyethylene terephthalate (PET) material, and so on), and may be single-ply or multiple (e.g., two) ply. In one or more implementations, the flexible bag construction may be generally transparent to allow the contents of the package 10 (e.g., popped popcorn) to be viewed. As used herein, the flexible bag construction 14 may be "generally transparent" if the contents of the bag construction 14 are at least partially visible through the bag construction 14. Thus, the flexible bag construction 14 may be generally transparent if the polyester film material from which the flexible bag construction 14 is constructed is completely transparent, translucent, transparent or translucent with opaque regions, transparent or translucent with printed indicia, tinted, and so on.

The flexible bag construction 14 provides an enclosure for the microwave poppable popcorn charge 32 during storage of the package 10 and popping. The unpopped microwave poppable popcorn charge 32 may include various components or additives such as fat/oil, salt, seasonings, nutrients, and so on, as are commonly used for microwave popcorn products. In one or more implementations, various components used as part of the charge 32, for example a fat, oil or other components, can be included within an internal pouch structure, for example the type described in the U.S. patent application Ser. No. 10/299,537, incorporated herein by reference.

Figure 2:
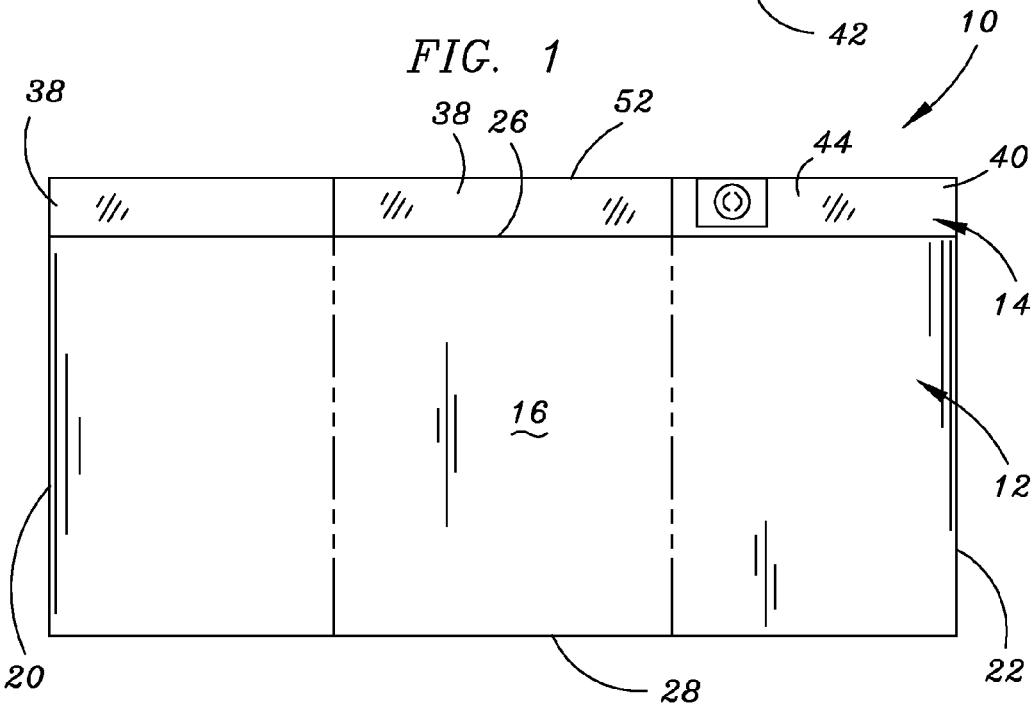
FIG. 2 is an isometric view of the microwave popcorn package shown in FIG. 1, wherein the package is shown in a collapsed configuration prior to popping.

The flexible bag construction 14 may generally be viewed as having a collapsed configuration and an expanded configuration. The flexible bag construction 14 occupies the collapsed configuration prior to popping, and the expanded configuration after popping. In FIGS. 1 and 2 microwave popcorn package 10 is depicted in a collapsed configuration, e.g., as the package 10 appears before a popping operation, for example, after the package 10 has been placed in (e.g., on the floor or turntable of) a microwave oven for a popping operation.

Figure 6:
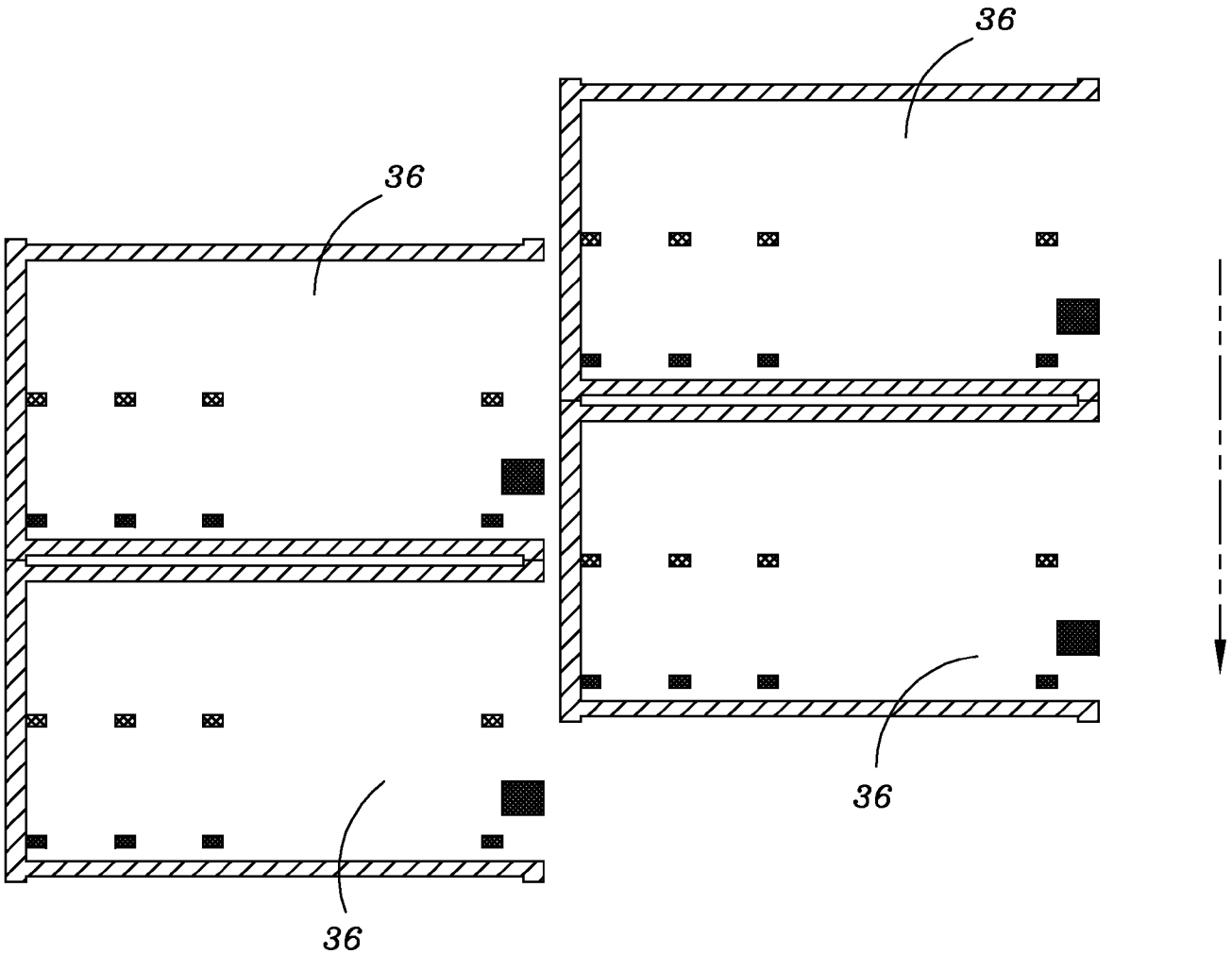
FIG. 6 is a plan view illustrating the application of adhesive to polyester film material stock to form the blank shown in FIG. 5.

In implementations, the flexible bag construction 14 may be folded from a single (e.g., one-piece) panel blank 36 (see FIG. 6). Folding of the blank 36 defines first and second opposite sides 38 and 40, with expansion structures (a bottom gusset 42 and a top gusset 44 are illustrated) positioned there between. The bottom and top gussets 42 and 44 may be longitudinal gussets that are "inwardly directed" so that center fold lines 46, 48 of the gussets 42, 44 are directed inwardly between sides 38, 40, from edges 50, 52, respectively. In one or more examples, the bottom gusset 42 may be larger (e.g., deeper) than the top gusset 44 since the bottom gusset 42 is configured to form the bottom of the bowl structure, while the top gusset 42 is configured to be removed following popping.

Following popping, the top gusset 44 is torn from the remainder of the microwave popcorn package 10 to expose the contents of the package 10 (e.g., popped popcorn) for consumption. When top gusset 44 is removed from the package 10, a bowl arrangement is provided from which the popped popcorn may be consumed. In some instances, after the top gusset 44 is removed, the consumer may increase the curvature to the sidewall construction 12 by pressing the side ends 20 and 22 of the first and second panels 16, 18 of the sidewall construction 12 together.

A variety of techniques may be used to facilitate removal of the top gusset 44 from the remainder of the flexible bag construction 14. For example, in the implementation illustrated, a tear line (e.g., a cut or notch) may be provided in the flexible bag construction 14 to facilitate opening of the bag construction 14 by removal of top gusset 44. The tear line may, for example, be positioned along an adhesive line at the base of the top gusset 44 where the flexible bag construction 14 attaches to the sidewall construction 12. Thus, the tear line is located below the top edge 26 of the sidewall construction 12 when the package 10 is in the expanded configuration. In other implementations, the flexible bag construction 14 may employ tear tape affixed to the bag construction 12 to facilitate tearing of the top gusset 44 from the remainder of the flexible bag construction 14. In such implementations, the tear tape may extend along and be generally parallel to the adhesive line at the base of the top gusset 44 where the flexible bag construction 14 attaches to the sidewall construction 12. Thus, the tear tape is likewise positioned below the top edge 26 of the sidewall construction 12 when the package 10 is in the expanded configuration. In one example, the tear tape may be fabricated from a high-temperature polyester material having a width of about 0.25 in. The tear tape and/or the underlying polyester film material may further be scored (e.g., using a laser) to facilitate tearing.

Figure 4:
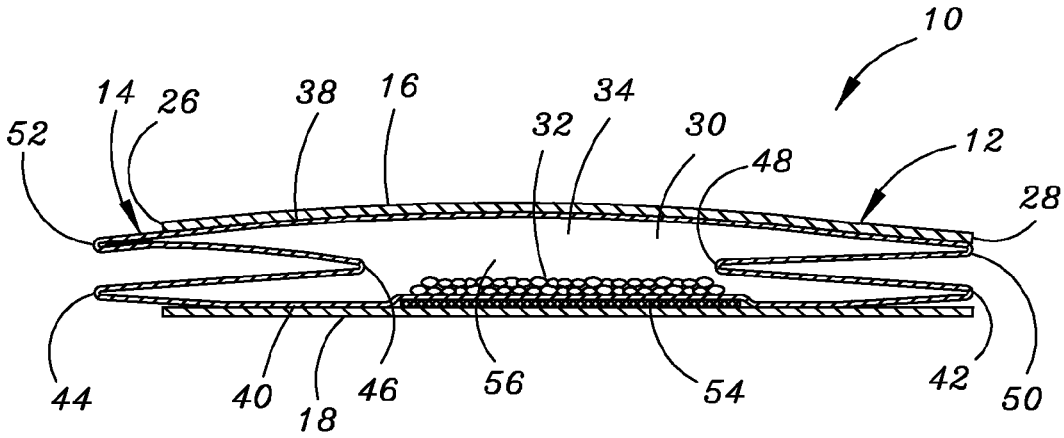
FIG. 4 is a cross-sectional view of the microwave popcorn package shown in FIG. 1.

In FIG. 4, the microwave popcorn package 10 is illustrated as including a microwave susceptor 54, which is shown positioned in thermoconductive relation to a central region 56 of the flexible bag construction 14. In the implementation illustrated, the microwave susceptor 54 is attached (e.g., adhered) directly to the side 40 of the flexible bag construction 14. The second panel 18 is then adhered to the side 40 over the microwave susceptor 54. In other implementations, the microwave susceptor 54 may be affixed to the second panel 18, and the second panel 18 and microwave susceptor 54 affixed to the side 40 of the flexible bag construction 14. The microwave susceptor 54 may comprise a low optical density microwave susceptor, a patterned microwave susceptor, and so on. Herein, the terms "low optical density microwave susceptor" and "patterned microwave susceptor" are meant to refer to constructions, which, upon exposure to microwave energy in a microwave oven, generate an amount of heat that is sufficient to provide popping, but do not cause excessive damage (e.g., melting, softening, scorching) to the adjacent portions of the flexible bag construction 14. For instance, in implementations where the flexible bag construction 14 is formed of a polyester film such as PET, the microwave susceptor 54 may be configured so that the temperature of the polyester film adjacent to the microwave susceptor 54 does not exceed a predetermined limit (e.g., the softening point of the film, the melting point of the film, and so on). In one example, the microwave susceptor 54 may be configured as a low optical density microwave susceptor that has an optical density of 0.10 so that the temperature of the polyester material adjacent to the microwave susceptor 54 does not exceed approximately 425-450° F. (approximately 218-232 C).

In FIG. 4, the unpopped popcorn charge 32 is shown positioned within the interior 34 of the flexible bag construction 14 in the central region 56 over, and in thermoconductive contact with, microwave susceptor 54. When the microwave popcorn package 10 is placed in a microwave oven in the general orientation shown in FIGS. 2 and 4, and is exposed to an adequate level of microwave energy, heat and generated steam and/or vapor will cause expansion of the flexible bag construction 14 and thus the package 10. As the flexible bag construction 14 expands during popping, the first and second panels 16, 18 are pushed away from one another and the bottom gusset 42 and top gusset 44 are opened. In the implementation shown, the first and second panels 16, 18 may have a width that is narrower than the flexible bag construction 14 so that at least part of the flexible bag construction 14 (e.g., part of the top gusset 44) project outwardly from between the first and second panels 16, 18 beyond the top edge 26. However, in other implementations, the first and second panels 16, 18 may have about the same width as the flexible bag construction 14 so that the first and second panels 16, 18 enclose the flexible bag construction 14 prior to popping.

In example implementations, the microwave popcorn package 10 may be configured to provide outer dimensions of at least about 20 cm (e.g., 20-40 cm) long (wide) by at least about 10 cm (e.g., 10 to 22 cm) high, when collapsed, and to contain 25 to 80 g unpopped popcorn kernels. The package 10, prior to a popping operation, can be conveniently folded in thirds (as shown in FIG. 1) and stored within a moisture barrier outer package or wrap, such as a polyethylene or oriented polypropylene wrap, for storage, shipment, and display. Several such wrapped packages 10 may be stored in a cardboard box, or like container, for shipping, sale, and storage. In addition, indicia (e.g., graphics, text, etc.) may be printed on the surfaces of the first and second panels 16, 18, as well as the flexible bag construction 14. Moreover, in implementations, the interior surface of the second panel 18 (and the first panel 16) may be treated to be grease resistant (e.g., with a film forming starch treatment, an alginate treatment, an acrylic resin treatment, a fluorochemical treatment, or the like).

Example Fabrication Techniques

Figure 5:
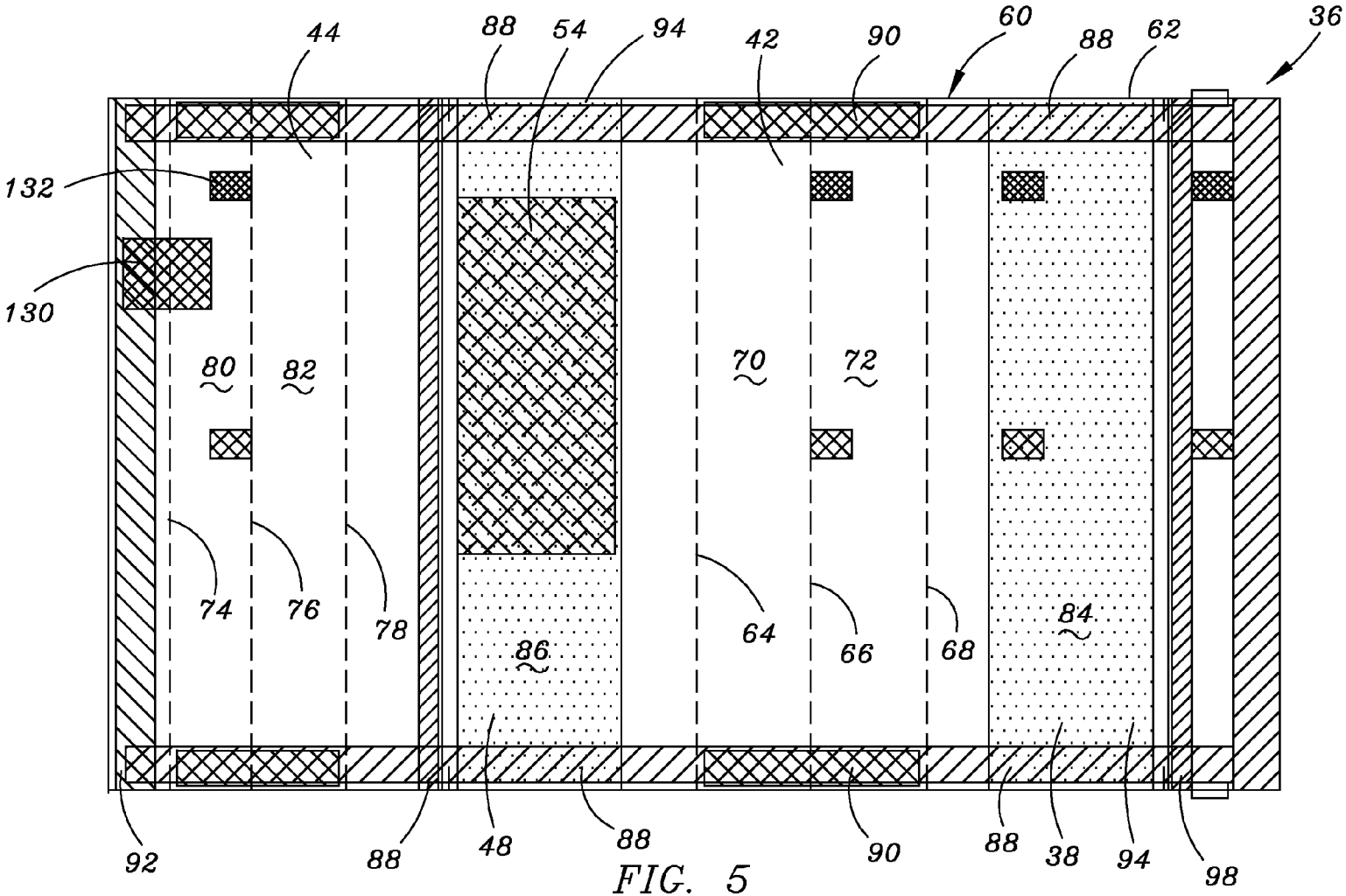
FIG. 5 is a plan view illustrating an example blank that may be folded into the bag construction of the microwave popcorn package shown in FIG. 1.
Figure 7:
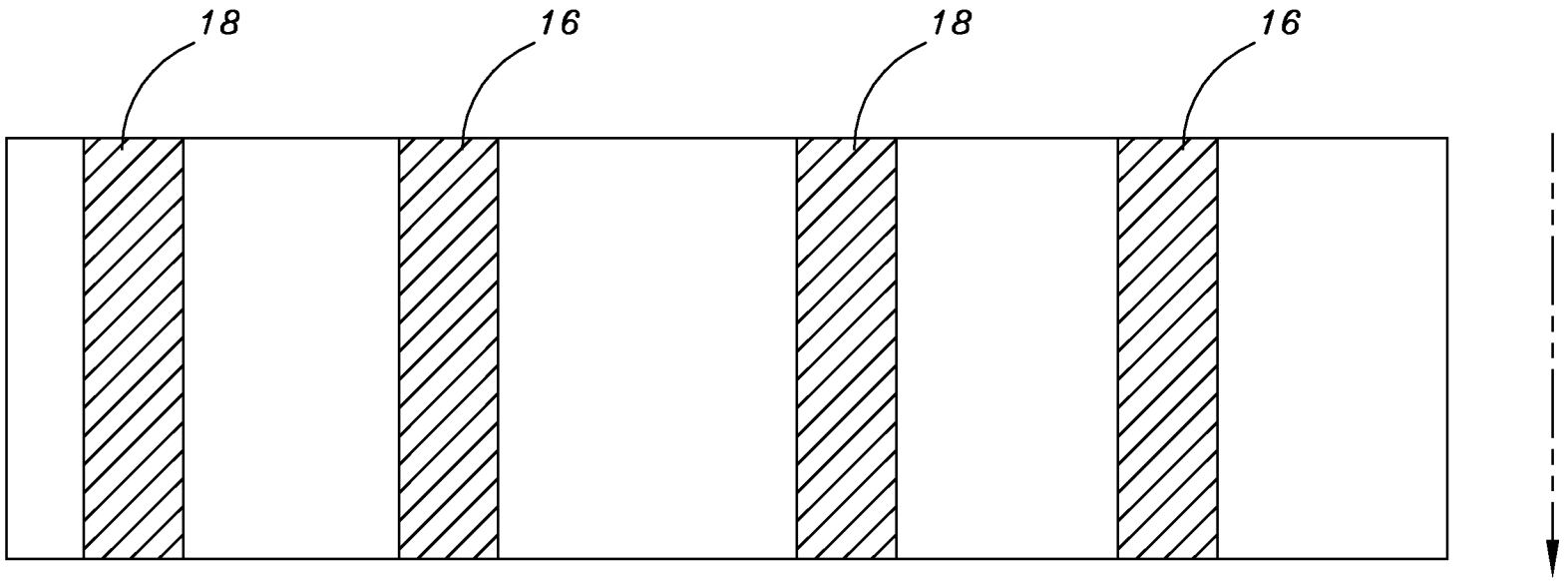
FIG. 7 is a plan view illustrating the application of paper stock to the polyester film material stock shown in FIG. 6.

Turning now to FIGS. 5, 6, and 7, example techniques for fabricating the microwave popcorn package 10. FIG. 5 illustrates an example blank 36 suitable for use in fabrication of the flexible bag construction 14 described herein in reference to FIGS. 1 through 4. In FIG. 5, the example blank 36 comprises a foldable one-piece (e.g., single piece) bag blank 60 having a single-ply construction 62 with the susceptor 54 affixed to the back side of the blank 60 (i.e., opposite side from the view of FIG. 5). As described herein, the bag blank 60 may comprise a polyester film (e.g., PET) material, and may be generally transparent as described above. For instance, in a specific example, the blank 60 may be formed of transparent 92 gauge PET film. However, the use of blanks 60 formed of other materials is contemplated. Additionally, the particular bag blank 60 depicted is rectangular. However, it is contemplated that the bag blank 60 may have other shapes.

The notations described below in relation to FIG. 5 indicate: locations of fold lines; locations of seal or seam material; score lines; and a location for attachment of the susceptor 54. Three folds along lines 64, 66, 68 are used to form the bottom gusset 42 with interior panels 70, 72 (see FIG. 4). Similarly, three folds along lines 74, 76, 78 are used to form the top gusset 44 with interior panels 80, 82 (see FIG. 4). The resulting bottom gusset 42 and top gusset 44 are longitudinal, internally directed gussets as described in the discussion of FIGS. 1 through 4.

Figure 3:
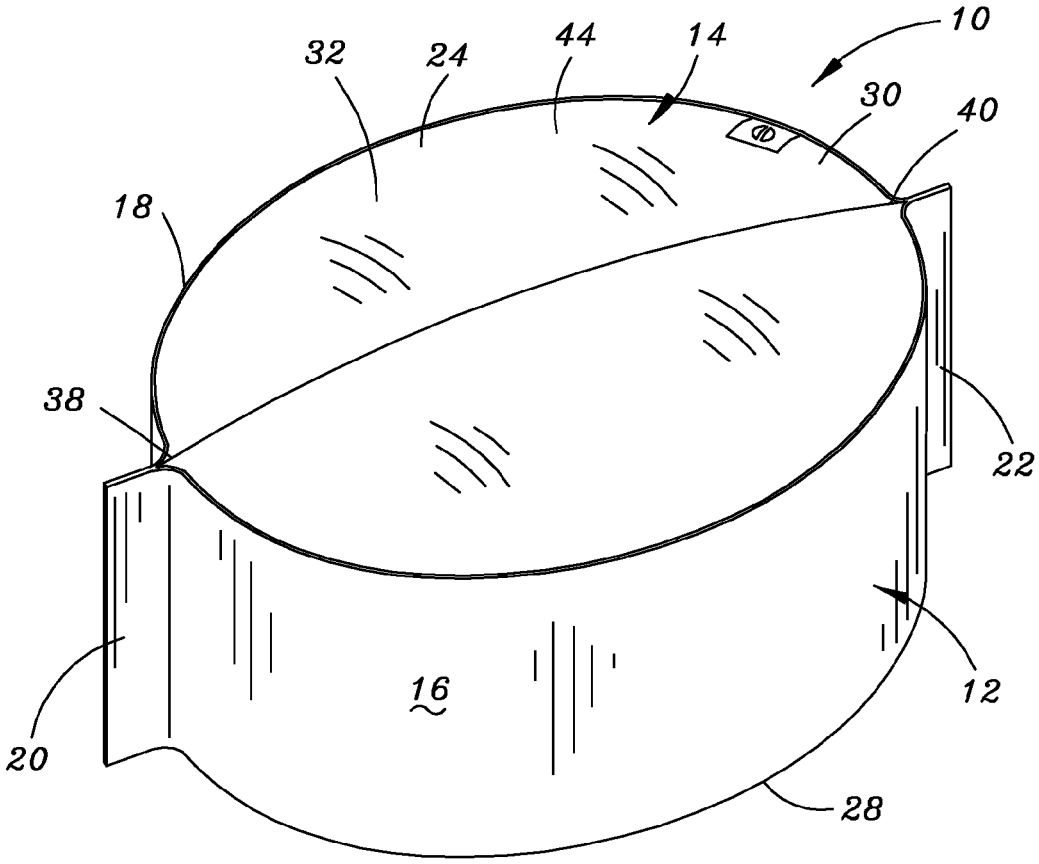
FIG. 3 is an isometric view of the microwave popcorn package shown in FIG. 1, wherein the package is shown in an expanded configuration following popping.

Opposite first and second sides 38, 40 of the flexible bag construction 14 are formed by regions 84 and 86, respectively. Adhesive in area 88 is used to seal the edges of sides 38, 40 together, thereby forming a bag configuration. The resulting side edges of the flexible bag construction 14 formed from folding the blank 60 may be positioned between the panels 16, 18 and secured into and along the end seams (FIG. 3). In regions 90, adhesive is also provided on the back side (i.e., opposite side from the view of FIG. 5) to provide the respective bottom and top gussets 42, 44. Adhesive in region 92 is further provided on the back side (i.e., opposite side from the view of FIG. 5) to seal the flexible bag construction 14 closed along the top gusset 44. Indicia, such as a tinted (e.g., red) bar, or the like, may be applied to areas to the blank 60, for example, to aide in providing instruction to direct a consumer in opening of the package 10 following popping.

As shown, the bag blank 60 includes adhesive areas 94 that are disposed on the back sides (i.e., opposite side from the view of FIG. 5) of the first and second sides 38, 40, respectively. The adhesive areas 94 secure the first and second sides 38, 40 of the flexible bag construction 14 to the interior of the sidewall construction 12. In FIGS. 4 and 5, the microwave susceptor 54 is affixed to the back side of the second side 40. Adhesive within adhesive areas 94 is then applied over the microwave susceptor 54.

Tear tape 98 may be applied to the blank 60 to facilitate tearing of the top gusset 44 from the remainder of the flexible bag construction 14. As shown, the tear tape 98 may extend along the edges of adhesive areas 94. The tear tape and/or the underlying blank 60 may further be scored to facilitate removal of the top gusset 44.

Assembly of the microwave popcorn package 10 described herein may be accomplished in a number of ways. For example, a bag blank 60 as shown in FIG. 5 may be provided. Adhesive may be applied to the bag blank 60. FIG. 6 illustrates the application of adhesive to polyester film material stock to form the blank 36 shown in FIG. 5. Panels 16, 18 and microwave susceptor 54 may be adhered to the bag blank 60 where indicated by the sealant fields of FIG. 5 before folding. The assembly is then folded into a bag construction 14 and sealed as indicated. In one example, bag blanks 36 and panels 16, 18 may be provided in one or more rolls of stock, which are unrolled and adhered together. For example, the polyester film material stock shown in FIG. 6 is illustrated as having a width of two or more blanks 36. Similarly, FIG. 7 illustrates the alignment of paper stock for application of panels 16, 18 to the polyester film material stock shown in FIG. 6. Microwave interactive element 54 may likewise be provided in a roll or strip, registered with the bag blank 60 (and/or panels 16, 18) and adhered thereto. The assembly may then be cut and folded. The popcorn charge may then be distributed into the flexible bag construction 25 into the region adjacent the microwave interactive element 45, and the flexible bag construction 25 sealed.

Example Vent Assembly

During popping, the flexible bag construction 14 is expanded from a collapsed configuration, shown in FIGS. 1 and 2, to an expanded configuration, shown in FIG. 3, by steam (and other gases) generated during popping and/or the expanded volume of the popped popcorn of the popcorn charge 32. This expansion places stress on the various seals of the bag construction 14 (e.g., seals along ends 20, 22), which, in some instances, could cause the seals to fail (open) spilling contents such as unpopped popcorn kernels, oils, seasonings, popped popcorn, and so on from the package 10.

Accordingly, the flexible bag construction 14 includes a vent assembly 100 configured to vent pressure within the bag construction 14 during popping. In the illustrated implementation, the vent assembly 100 is formed within the top gusset 44 of the flexible bag construction 14 and is spaced away from an end (e.g., end 22) of the package 10. For instance, in one example, the vent assembly 100 may be provided in the top gusset 44 so that the center of the vent assembly 100 is approximately 3 in. from an end (e.g., end 20 or end 22) of the microwave popcorn package 10. In this location, the vent assembly 100 is positioned away from the seals of the flexible bag construction 14 located at ends 20, 22. The consumer may thus grip the package 10 (e.g., at ends 20, 22) away from the vent 100 when removing the package 10 from a microwave oven following popping. Moreover, this location allows the vent assembly 100 to be spaced away from the popcorn charge 32 when the microwave popcorn package 10 is folded in thirds for storage and shipping as shown in FIG. 1; helping to prevent the wicking of oils, seasonings and so forth through the vent assembly 100.

FIGS. 8A, 8B, 8C, and 8D illustrate the vent assembly 100 in greater detail. In the illustrated implementation, the vent assembly 100 is comprised of a first portion 102 of the bag construction 14 and a second portion 104 of the bag construction 14. As shown, the first portion 102 is comprised of a section of the side 38 of the bag construction 14 adjacent to the fold line 74 at edge 52 within a strip of the bag construction 14 that extends beyond the top edge 26 of the first panel 16. Similarly, the second portion 104 comprises a section of an interior panel 80 of the gusset 44 adjacent to the fold line 74 at edge 52. The first portion 102 and the second portion 104 are thus in mirrored relation to one another so that the second portion 104 is configured to be folded against the first portion 102 when the gusset 44 is formed. In FIGS. 8A through 8D, the first portion 102 and the second portion 104 are illustrated as being generally rectangular in shape and of at least approximately the same size. However, it is contemplated that the first portion 102 and the second portion 104 may have other shapes (e.g., square, circular, oval, triangular, polygonal, irregular, and so on), and thus are not necessarily limited to the illustrated shape. Moreover, it is contemplated that the first and second portions 102, 104 may be of different sizes.

Figure 8A:
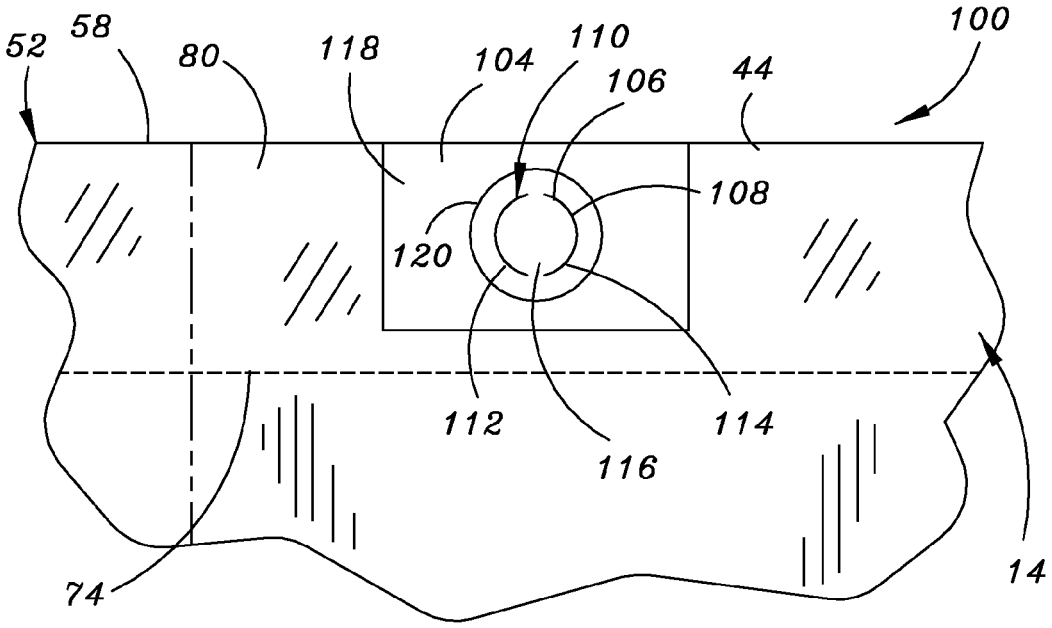
FIGS. 8A and 8B are partial side elevation views of the microwave popcorn package shown in FIG. 1, further illustrating the vent assembly prior to venting.

The second portion 104 includes a venting structure 106 formed in the sheet of polyester film material from which the bag construction 14 is fabricated. As shown in FIG. 8A, the venting structure 106 is comprised one or more scores 108 formed within the second portion 104. In the example shown, the scores 108 extend only partially through the polyester film material and form a weakened area within the second portion 104. However, it is contemplated that, due to manufacturing variations, at least some portion of one or more of the scores 108 may extend completely through the polyester film material. Moreover, it is contemplated that in some implementations of the vent assembly 100, the venting structure 106 may include apertures forming in the polyester film material in place of, or, in addition to, the scores 108 illustrated in FIG. 8A. A variety of fabrication techniques may be used to form the scores 108 in the polyester film material. For example, in the illustrated example, the scores 108 may be stamped into the polyester film material during fabrication of the microwave popcorn package. However, it is contemplated that the scores 108 may be formed prior to fabrication and/or may be formed using other techniques such as laser scoring, and so forth.

The scores 108 of the venting structure 106 may have a variety of shapes. In one or more implementations, at least one of the one or more scores 108 may have a generally curved shape. For example, in FIGS. 8A and 8B, the venting structure 106 illustrated comprises a butterfly vent 110 that includes a first semi-circular score 112 and a second semi-circular score 114 formed in the polyester film material. As shown, the second semi-circular score 114 is arranged in mirrored relation to the first semi-circular score 112, and is spaced apart from the first semi-circular score 112 to form a land area 116 there between that separates the scores 112, 114.

Figure 8B:
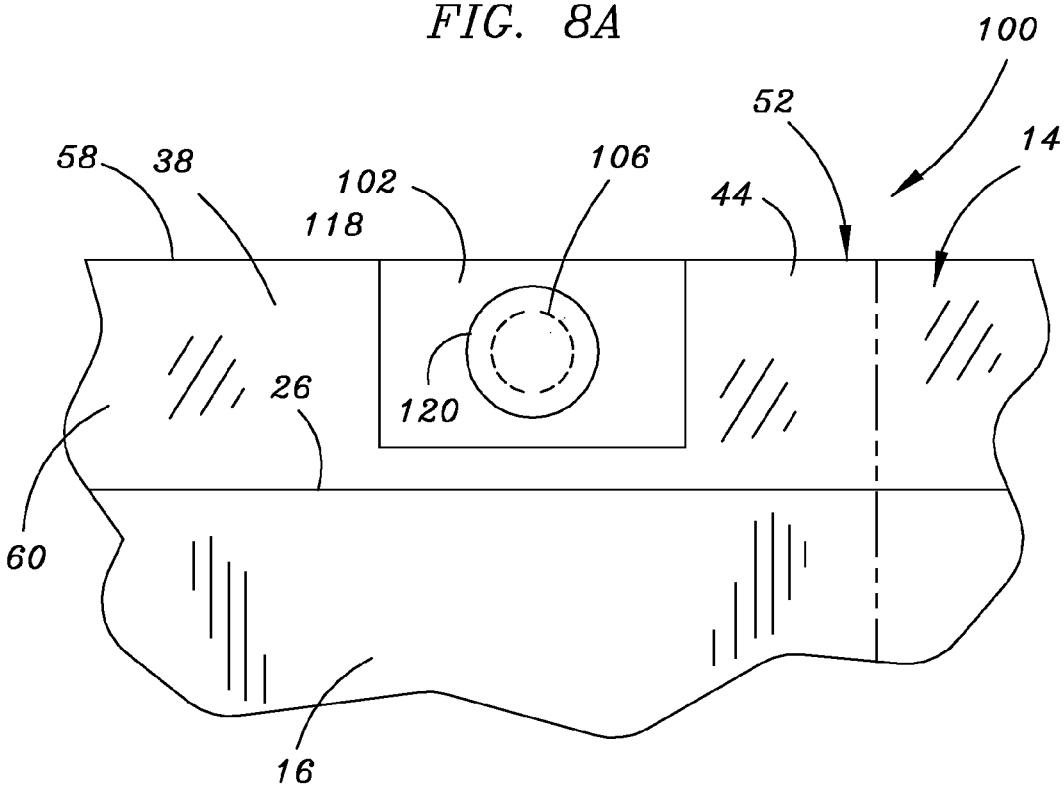

An adhesive 118 is applied to at least one of the first portion 102 or the second portion 104 of the bag construction 14. While the bag construction 14 is in the collapsed configuration, as shown in FIGS. 8A and 8B, the first portion 102 is folded against the second portion 104. Thus, in the collapsed configuration, the adhesive 118 causes the first portion 102 to be adhered to the second portion 104 to form a seal 120 around the venting structure 106. For example, in the illustrated example, the adhesive 118 may be applied to both the first portion 102 and the second portion 104 to provide an adhesive-to-adhesive contact seal 120 when the first portion 102 is folded against the second portion 104. Prior to venting, the seal 120 at least partially seals the venting structure 106 so that the contents of the bag construction 14 (e.g., unpopped popcorn kernels, oils, seasonings, and so on) are prevented from spilling from the bag construction 14 through the venting structure 106.

In the implementation shown in FIGS. 8A and 8B, the seal 120 comprises a region of the first and second portions 102, 104 surrounding the venting structure 106 in which the adhesive 118 is further activated to join the first portion 102 to the second portion 104. The seal 120 may, for example, include a region around the venting structure 106 wherein heat sealing is used to cause the adhesive 118 to secure the first portion 102 to the second portion 104 within the region. In FIGS. 8A and 8B, the activated (e.g., heat sealed) region is generally circular in shape. However, it is contemplated that the region may have other shapes (e.g., oval, square, rectangular, polygonal, irregular, and so on) without departing from the scope and spirit of this disclosure. Moreover, it is contemplated that adhesive 118 applied to the first and second portions 102, 104 outside of the seal region may function to further seal the venting structure 106, thereby preventing contents of the bag construction 14 (e.g., unpopped popcorn kernels, oils, seasonings, and so on) from migrating into the seal region around the venting structure 106.

Figure 8C:
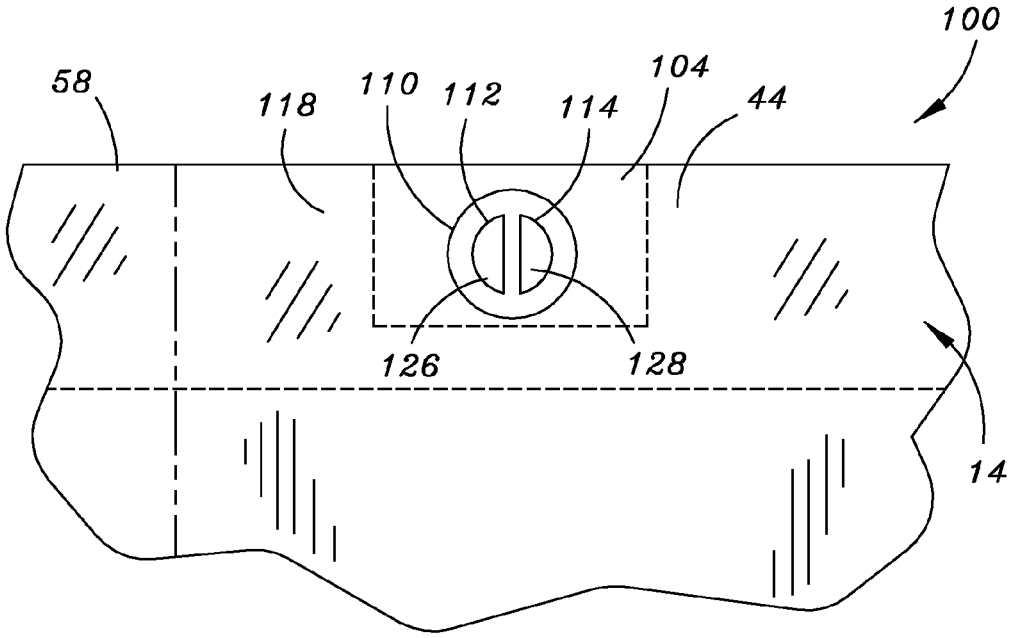
FIGS. 8C and 8D are partial side elevation views of the microwave popcorn package shown in FIG. 1, further illustrating the vent assembly following venting.
Figure 8D:
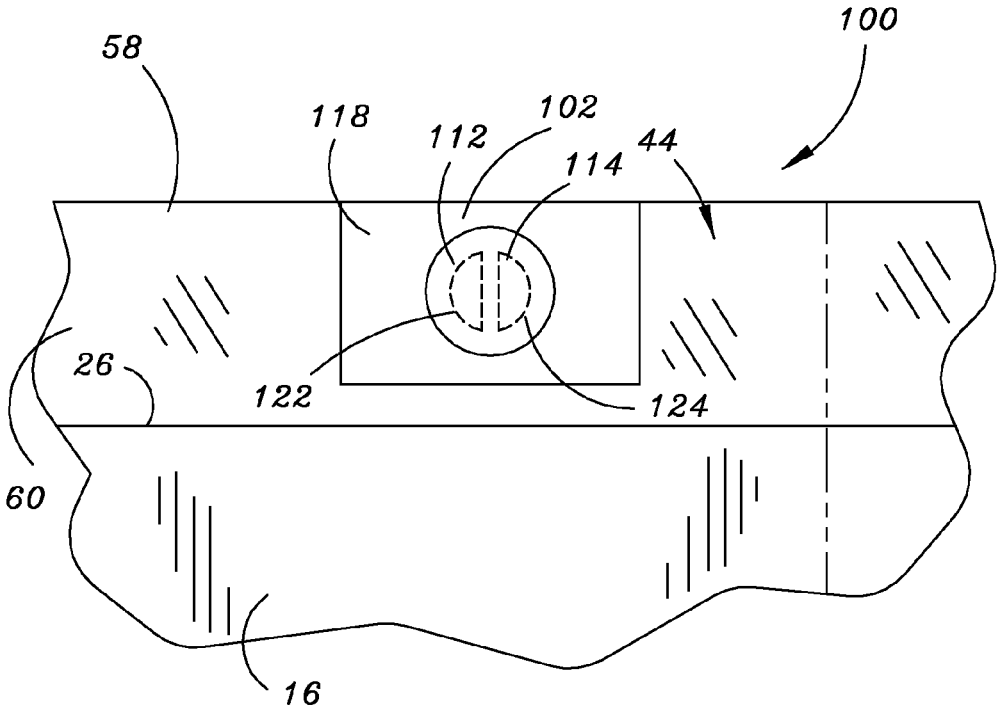

As the flexible bag construction 14 expands to the expanded configuration during popping (FIG. 3), the gusset 44 is opened causing the interior panel 62 of the gusset 44 to be pulled away from the side 38 of the bag construction 14 about the fold line 58. Thus, during expansion of the flexible bag construction 14, the second portion 104 tends to be pulled away from the first portion 102. As the first and second portions 102, 104 are pulled apart; the adhesive 118 is configured to release the first portion 102 from the second portion 104 to allow the venting structure 106 to at least partially open, venting the bag construction 14. For instance, as shown in FIGS. 8C and 8D, the first and second semi-circular scores 112, 114 of the butterfly vent 110 may be configured to at least partially open when the first portion 102 is released from the second portion 104. The first and second semi-circular scores 112, 114 define a first flap 122 and a second flap 124, respectively. When the first portion 102 is pulled away from the second portion 14 (e.g., due to expansion of the bag construction 14), at least part of either or both of the first and second flaps 122, 124 remain adhered to the first portion 102. Thus, the first and second flaps 122, 124 are pulled away from the remainder of the second portion 104 creating one or more vent apertures 126, 128 in the second portion 104 through which steam (and other gases) may vent from the bag construction 14. In some implementations, the parts of the first and second flaps 122, 124 that are pulled away from the second portion 104 may remain adhered to the first portion 102 by the adhesive 118 after the first portion 102 is released from the second portion 104, and thus may detach from the second portion 104. Moreover, in some instances it is contemplated that portions of the second portion 102 other than the first and second flaps 122, 124 may pull from the second portion 104, and may remain adhered to the first portion 102, creating vent apertures 126, 128 that are irregular in shape.

The vent assembly 100 is configured to provide efficient venting of steam and other gases from the flexible bag construction 14 during popping. For example, the vent assembly 100 may include a venting structure 106 that is sufficiently large to vent the bag construction prior to failure (opening) of seals within the bag construction 14 (e.g., seals along ends 20, 22) due to pressure within the bag construction 14 during popping. In examples, the venting structure 106 may comprise a butterfly vent 110 that includes a first semi-circular score 112 and a second semi-circular score 114 having diameters of between about 0.1875 in. and about 0.3125 in. In one specific example, the first semi-circular score 112 and the second semi-circular score 114 may have diameters of about 0.25 in., while the land 116 has a width of about 0.04 in. When opened, each semi-circular score 112, 114 may provide a vent aperture 126, 128 having an area of at least about 0.02 $in^2$ if fully opened. Moreover, while the microwave package assembly 10 is illustrated as including one vent assembly 100, it is contemplated that two or more vent assemblies 100 may be provided in the flexible bag assembly 14 without departing from the scope and spirit of the present disclosure.

In implementations, the vent assembly 100 may be configured to vent (open) at an approximate, predetermined time during the popping operation (e.g., near the end of a popping operation). In this manner, the flexible bag construction 14 may be allowed to inflate during popping so that visibility of the popping popcorn within the bag construction 14 is enhanced and/or a desired pressure within the bag construction 14 is maintained to enhance popping of the popcorn. For example, the seal strength provided by the adhesive 118 may be selected to prevent separation of the first portion 102 from the second portion 104, and thus, venting of the venting structure 106, until the bag construction 14 has reached a desired degree of expansion (inflation), but to allow separation of the first portion 102 from the second portion 104, and thus venting by the venting structure 106, prior to failure of seals within the bag construction 14.

A variety of adhesives 118 may be employed to adhere the first portion 102 to the second portion 104. In one example, the adhesive 118 may be a water-based adhesive providing approximately a 0.5 lb seal. In this example, the seals of the flexible bag construction 14 may also be made using a water-based adhesive. However, the adhesive used may provide seals having strengths greater than that of the adhesive 118 (e.g., providing approximately a 1 lb. to 2 lb. seal). The adhesive 118 of the vent assembly 100 may, for example have a different composition than the adhesive used in the seals of the flexible bag construction 14, and/or may be applied to the polyester film material in a lesser concentration. Solvent-based adhesives may also be used.

As shown in FIG. 5, the adhesive 116 may be applied to the bag blank 36 as an adhesive field 130. Scores 108 (e.g., semi-circular scores 112, 114) may be stamped into the polyester film material within the adhesive field 130 prior to, or during, folding of the bag blank 36 to form the flexible bag construction 14. As the top gusset 44 is folded, the first and second portions 102, 104 are folded together as described above, providing an adhesive-on-adhesive contact. The first and second portions 102, 104 may then be heat sealed to form seal 120 around the venting structure 110 (e.g., around scores 108 stamped into the polyester film material). Folding and sealing of the blank 36 to form the microwave popcorn package is then completed. A popcorn charge 36 inserted into the bag construction 14 as shown in FIG. 4. Adhesive applied at areas 132 helps to maintain the shape of the bag construction 14 as the popcorn charge 32 is inserted and prevents inadvertent opening of the vent assembly 100.

Example Use

The microwave popcorn packages 10 described above may be sealed within a moisture protective outer barrier once assembled. In some instances, the microwave popcorn packages 10 may further be packaged into boxes for storage, shipping, and/or display. In use, the package 10 is removed from the moisture barrier outer wrap and placed in a microwave oven with the second panel 18 down. A typical microwave popcorn package 10 may be configured to yield full popping within a period of about 2 to 5 minutes in a typical household microwave oven, on high setting. After popping, top gusset 44 is removed to allow the microwave popcorn package 10 to function is a container (e.g., a bowl) for consumption of the popped popcorn.

Conclusion

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microwave popcorn package comprising:

a sidewall construction defining an interior; and a flexible bag construction formed of a polyester film material secured to the interior of the sidewall construction, the flexible bag construction configured to contain a popcorn charge and to be expandable between the collapsed configuration and the expanded configuration when the popcorn charge is subjected to a popping operation;

a vent assembly formed in the flexible bag construction, the vent assembly including:

a first portion of the bag construction;

a second portion of the bag construction, the second portion including a venting structure formed in the sheet of polyester film material, wherein the venting structure comprises a butterfly vent having a first semi-circular score and a second semi-circular score, the second semi-circular score in mirrored relation to the first semi-circular score and spaced apart from the first semi-circular score to form a land area there between; and an adhesive applied to at least one of the first portion or the second portion, the adhesive configured to adhere the first portion to the second portion so that the venting structure is at least partially sealed while the bag construction is in the collapsed configuration and to release the first portion from the second portion as the bag construction expands to the expanded configuration to allow the venting structure to at least partially open.

2. The microwave popcorn package as recited in claim 1, wherein the first and second semi-circular scores are configured to at least partially open when the first portion is released from the second portion.

3. The microwave popcorn package as recited in claim 2, wherein the first and second semi-circular scores define a first flap and a second flap, at least part of the first flap and the second flap configured to pull away from the second portion.

4. The microwave popcorn package as recited in claim 3, wherein the at least part of the first and second flap remain adhered to the first portion when the first portion is released from the second portion to form one or more vent apertures in the second portion.

5. The microwave popcorn package as recited in claim 1, wherein the first semi-circular score and the second semi-circular score have diameters of between about 0.1875 inches and about 0.3125 inches.

6. The microwave popcorn package as recited in claim 1, wherein the first semi-circular score and the second semi-circular score have diameters of about 0.25 inches and the land has a width of about 0.04 inches.

7. The microwave popcorn package as recited in claim 1, wherein the bag construction includes a gusset having at least one gusset fold, the first portion and the second portion adjacent to the gusset fold in the bag construction.

8. The microwave popcorn package as recited in claim 1, wherein the bag construction includes at least one seal, the venting structure configured to at least partially open to vent the bag construction prior to failure of the seal due to pressure within the bag construction.

9. The microwave popcorn package as recited in claim 1, wherein the polyester film material comprises biaxially-oriented polyethylene terephthalate (PET).

10. The microwave popcorn package as claimed in claim 1, wherein the polyester film material is generally transparent.

11. The microwave popcorn package as recited in claim 1, wherein the bag construction and the sidewall construction form a container having vertically rigid sidewalls in the expanded configuration.

12. The microwave popcorn package as recited in claim 1, wherein the bag construction includes a top gusset, the top gusset containing the vent assembly and configured to be removed from a remainder of the bag construction following the popping operation.

13. The microwave popcorn package as recited in claim 1, wherein the sidewall construction if formed of a paper.

14. A microwave cooking package comprising:

a sidewall construction defining an interior; and a flexible bag construction formed of a polyester film material secured to the interior of the sidewall construction, the flexible bag construction configured to contain a food product and to be expandable between the collapsed configuration and the expanded configuration when the popcorn charge is subjected to a popping operation;

a vent assembly formed in the flexible bag construction, the vent assembly including:

a first portion of the bag construction;

a second portion of the bag construction, the second portion including a vent formed in the sheet of polyester film material, wherein the vent comprises a butterfly vent having a first semi-circular score and a second semi-circular score; and an adhesive applied to at least one of the first portion or the second portion, the adhesive configured to adhere the first portion to the second portion so that the vent is at least partially sealed while the bag construction is in the collapsed configuration and to release the first portion from the second portion as the bag construction expands to the expanded configuration to allow the vent to at least partially open.

15. A microwave popcorn package comprising:

a sidewall construction defining an interior; and a flexible bag construction formed of a polyester film material secured to the interior of the sidewall construction, the flexible bag construction configured to contain a popcorn charge and to be expandable between the collapsed configuration and the expanded configuration when the popcorn charge is subjected to a popping operation;

a vent assembly formed in the flexible bag construction, the vent assembly including:

a first portion of the flexible bag construction, wherein the first portion is formed on an inner first side of a gusset that is oriented along the width of the flexible bag construction;

a second portion of the flexible bag construction, wherein the second portion is formed on an inner second side of the gusset that is oriented along the width of the flexible bag construction, the second portion including a venting structure formed in the sheet of polyester film material, wherein the venting structure comprises a butterfly vent having a first semi-circular score and a second semi-circular score, the second semi-circular score in mirrored relation to the first semi-circular score and spaced apart from the first semi-circular score to form a land area there between; and an adhesive applied to at least one of the first portion or the second portion, the adhesive configured to adhere the first portion to the second portion so that the venting structure is at least partially sealed while the bag construction is in the collapsed configuration and to pull the first portion inwardly and from the second portion as the bag construction expands to the expanded configuration to allow the venting structure to at least partially open.

16. The microwave popcorn package as recited in claim 15, wherein the venting structure comprises one or more scores formed in the second portion, the scores configured to at least partially open when the first portion is pulled inwardly and from the second portion.

17. The microwave popcorn package as recited in claim 16, wherein at least one of the one or more scores has a generally curved shape.

18. The microwave popcorn package as recited in claim 15, wherein the bag construction includes at least one seal, the venting structure configured to at least partially open to vent the bag construction prior to failure of the seal due to pressure within the bag construction.

19. The microwave popcorn package as recited in claim 15, wherein the polyester film material comprises biaxially-oriented polyethylene terephthalate (PET).

20. The microwave popcorn package as claimed in claim 15, wherein the polyester film material is generally visually transparent.

21. The microwave popcorn package as recited in claim 15, wherein the bag construction and the sidewall construction form a container having vertically rigid sidewalls, with respect to the flexible bag, in the expanded configuration.

* * * * *